United States Patent [19]

Avila et al.

[11] Patent Number: 4,624,126

[45] Date of Patent: Nov. 25, 1986

[54] HYDRAULIC PRESS

[76] Inventors: Robert M. Avila, 249 Calle Esmarca, San Clemente, Calif. 92672; Glenn A. Hoffman, Jr., 8362 Seaport Dr., Huntington Beach, Calif. 92764

[21] Appl. No.: 780,639

[22] Filed: Sep. 26, 1985

[51] Int. Cl.[4] ..... B21J 9/18

[52] U.S. Cl. ..... 72/453.14; 72/453.12; 91/171; 91/515; 100/46; 100/258 A

[58] Field of Search ..... 72/453.07, 453.09, 453.12, 72/456, 413, 453.14; 100/46, 258 A, 269 R; 91/171, 515; 254/89 H

[56] References Cited

U.S. PATENT DOCUMENTS 3,635,074 1/1972 Moos et al. ..... 72/453.14

4,341,106 7/1982 Hackett ..... 72/453.07

*Primary Examiner*—W. D. Bray

*Attorney, Agent, or Firm*—Gausewitz, Carr & Rothenberg

[57] ABSTRACT

A hydraulic press having at least two cylinders adapted for providing relative displacement between the upper and lower platens of a hydraulic press, each cylinder being in fluid communication with only one chamber of a multiple chamber hydraulic system utilizing a common ram operating through all chambers, the ram portion in each chamber having a predetermined ratio of area of the ram in the direction of actuation to volume of hydraulic fluid within its chamber to provide equal find displacement in each chamber or movement of the ram.

19 Claims, 3 Drawing Figures

HYDRAULIC PRESS

BACKGROUND OF THE INVENTION

The background of the invention will be discussed in two parts.

1. Field of the Invention

This invention relates to hydraulic presses, and more particularly, to a hydraulic press cylinder arrangement for equalizing forces in the event of unequal loading of the press.

2. Description of the Prior Art

In punch presses, the workpiece is positioned on a table, and either the table or a platen carrying the die is moved relative to the other. The general construction of such hydraulic presses consists of one cylinder located centrally relative to the fixed posts or frame that make up the structure of the press. In such structures, reliance is placed on the frame to maintain a parallel attitude between the platen and table. In many instances, unequal loading exists when working pressures vary.

In some hydraulic presses, this movement is accomplished by hydraulic cylinders, usually an even number such as two or four, positioned at opposite sides or at opposite corners of a platen, thus surrounding the load with pressure on all sides. Although this would appear to have some merit, in truth, without unequal loading and multiple cylinders, the lesser loaded cylinder will receive more fluid, thus creating a cocking or tilting between the platen or table, or between the upper and lower platens. Various attempts have been made to provide some means for maintaining the parallel relation between the table and platen by elaborate hydraulic mechanisms and valving. Some such systems employed rack and pinion couplings, cable and pulley couplings, and crank and lever couplings to maintain the proper attitude. Other attempts have included complicated valve control systems to overcome the problem.

Exemplary of the prior art is U.S. Pat. No. 2,976,798 entitled "Level Operating Multiple Ram Press," issued to Christianson on Mar. 28, 1961, the patent disclosing an arrangement for hydraulic presses in which a series of primary cylinders are utilized equal in number to the secondary or ram cylinders of the press, with a confined hydraulic circuit for each cylinder. The pistons of the primary cylinders are tied together mechanically in axially-aligned relation, and the pistons of the ram cylinders are also tied together mechanically.

U.S. Pat. No. 3,023,676 is issued to Howahr et al. on Mar. 13, 1962, and is entitled "Hydraulic Presses," such patent disclosing an hydraulic forging press which includes a cross-head and two chain-link-shaped members forming two parallel pairs of columns of rectangular section which are slidable longitudinally relative to the cross-head, with the cross-head carrying one platen or die and the other platen or die being carried on a cross-beam extending between adjacent ends of the link-shaped members.

Another press apparatus is shown in U.S. Pat. No. 3,324,704, entitled "Press Brakes," issued to Savory on June 13, 1967, such patent showing a brake apparatus for bending metal in which a piston rod on one side is coupled to a connecting member which may be pivoted out of the way for access to the workpiece.

A press with leveling means is shown and described in U.S. Pat. No. 4,157,066, entitled "Presses Having Platen Leveling Means," such patent issuing to Pretty on June 6, 1979, the hydraulic mechanism having provision for restricting fluid flow return from a cylinder when one column of the press advances relative to another, preferably on diagonally-opposite columns.

Another hydraulic system is shown and described in U.S. Pat. No. 4,161,229, issued to Mifsud on July 17, 1979, such patent being entitled "Hydraulic Synchronizing System for Coordinating Movements of the Vibrator Guide Rods," the system including a double-piston power source and a drain valve in fluid communication with the hydraulic lift cylinders of a vehicle-mounted vibratory seismic energy source. The double-piston power source supplies the lift cylinders with substantially equal volume of hydraulic fluid, and the drain valve adjusts the flow of hydraulic fluid out of the lift cylinders.

Accordingly, it is an object of the present invention to provide a new and improved hydraulic press and method of actuation thereof.

It is another object of the present invention to provide a new and improved hydraulic cylinder arrangement for use in a hydraulic press.

It is a further object of the present invention to provide a new and improved hydraulic system with an air or oil booster actuating a ram member through a plurality of axially aligned chambers with a ram section in each chamber having a cross-section of different area with each chamber in fluid communication with a cylinder of the press.

SUMMARY OF THE INVENTION

The foregoing and other objects of the invention are accomplished by providing an hydraulic press having at least two cylinders adapted for providing relative displacement between the upper platen and lower bed, each cylinder being in fluid communication with only one chamber of a multiple chamber hydraulic system utilizing a common ram operating through all chambers, the ram having a ram sections in each chamber. The dimensions of the ram and chamber are predetermined to provide, upon axial displacement of the ram, equal volumes of hydraulic fluid to each cylinder.

Other objects, features and advantages of the invention will become apparent from a reading of the specification, in which like reference numerals to like elements in the several views.

DESCRIPTION OF THE PREFERRED EMBODIMENT

Figure 1:
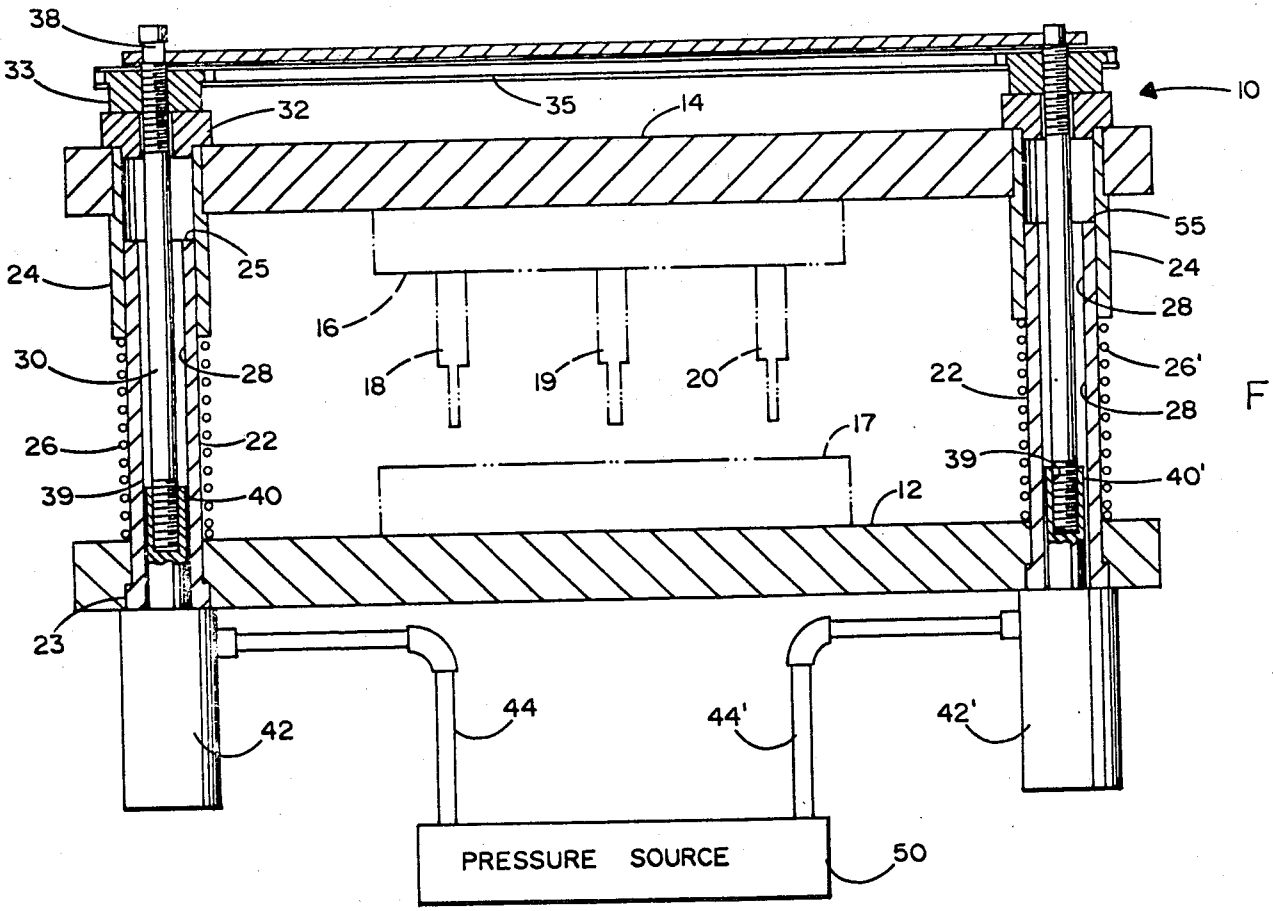
FIG. 1 is a vertical sectional view showing an hydraulic press incorporating the present invention.

Referring now to the drawings, and particularly to FIG. 1, there is shown an hydraulic press, generally designated 10, which may be a punch press or the like. It is to be understood that the invention herein is equally applicable to any type of hydraulic press system requiring the application of tremendous force to the bending, shearing, punching or die cutting of metals, or similar operations.

The press 10 includes a lower stationary surface referred to as a platen or bed 12, and an upper movable structure referred to as a platen 14. In some such "presses," the reverse is true. That is, the upper platen is stationary and the lower platen or bed is vertically movable. However, in either type of press, hydraulic pressure is normally employed to provide the relative displacement. In the press 10, upper and lower dies 16, 17 are mounted to the platen 14 and bed 12, respectively. The upper die 16 includes three punches 18–20 adapted to cooperate with corresponding holes (not shown) in lower die 17 with a metal workpiece interposed therebetween during operation to punch holes therein.

The bed 12 is suitably supported in a conventional manner. Mounted fixedly to the bed 12, and projecting upwardly therefrom, are guide pins 22. Preferably, each guide pin 22 is press-fit upwardly through openings in bed 12, there being a flange 23 at the lower end of each pin 22 to limit the degree of pressing movement. Flange 23 fits into a corresponding counterbore in the associated guide pin opening in bed 12.

Bushings 24 are mounted slidably on guide pins 22 at the upper ends thereof, and extend upwardly above the extreme upper end surfaces 25 of the guide pins 22. As shown, the bushings 24 have necked-down upper end portions which extend upwardly through openings in platen 14, and terminate at the same plane as the upper surface of platen 14. Helical compression springs 26 are mounted around the guide pins 22 and are seated between the upper surface of bed 12 and the lower ends of bushings 24. The springs 26 maintain bushings 24, and thus platen 14, pushed upwardly as far as permitted by the structure of press 10.

The guide pins 22 have longitudinally-extending bores 28 which receive axially therein pull rods 30 which are formed of high-strength steel. The upper ends of pull rods 22 pass through an axial opening in a spacer member 32 and then into threadable engagement with a suitable adjusting member such as a sprocket gear 33, the spacer 32 having a necked-down portion 34 that fits within the upper end of the associated bushing 24.

Although not forming a part of the instant invention, to provide initial positioning of the platen 14, the sprockets 33 may be interconnected by a chain member 35 for simultaneous rotation and adjustment of the initial positions of the pull rods 30. This adjustment may be accomplished by virtue of the upper ends 38 of pull rods 30 being suitably configured, such as with a square or hexagonal configuration, for receiving a wrench of the like.

The lower ends of the pull rods 30 are threadably inserted into openings 39 of piston rods 40, which are hydraulically actuated by the respective cylinders 42 and 42' thereof. These hydraulic cylinders 42 and 42' are identical to each other, and their piston rods 40 and 40' are pulled upwardly by springs 26 and 26', as far as permitted by the internal construction of cylinders 42 and 42'. This upward force is exerted at all times other than those times when hydraulic fluid is injected into cylinders 42 and 42' from a suitable source 50 of hydraulic pressure.

In accordance with the present invention, in order to minimize or eliminate the effect of unequal forces creating a cocking of the platen 14 relative to the table or bed 12, each cylinder 42, 42' is provided with a separate hydraulic fluid feed line 44, 44' from a common hydraulic pressure source 50.

Figure 2:
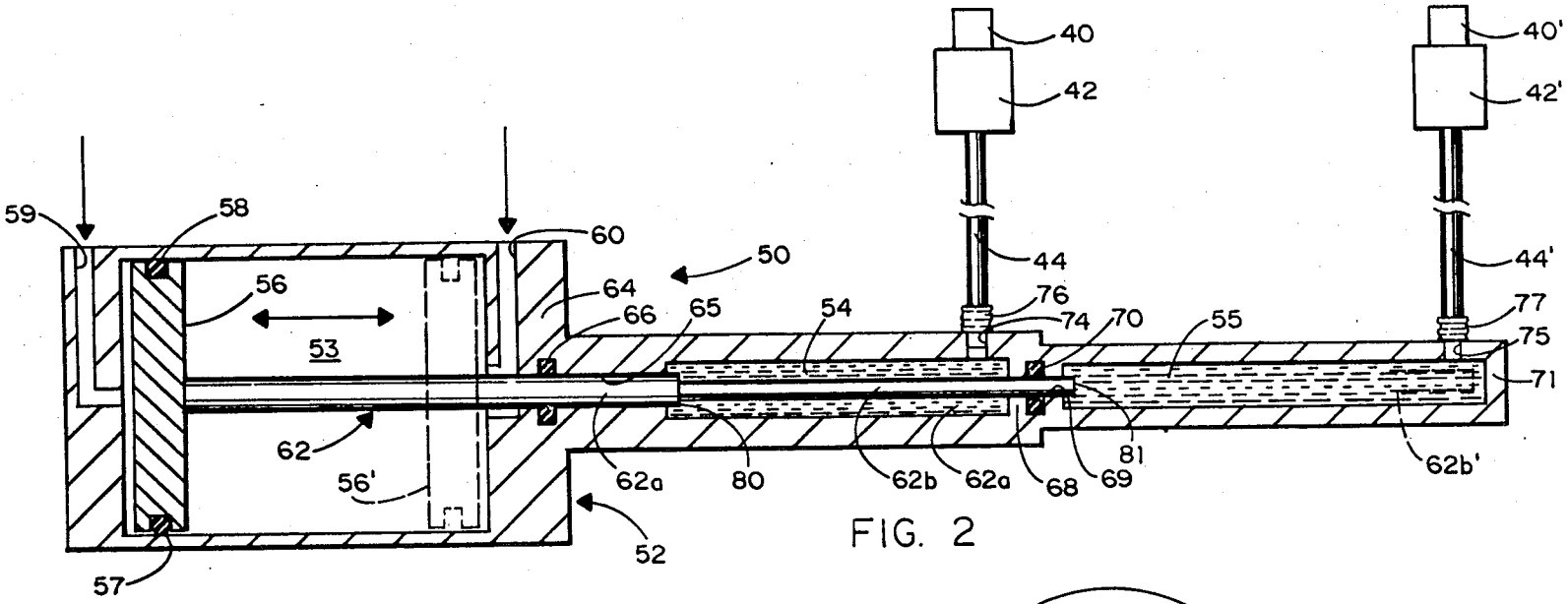
FIG. 2 is a diagrammatic view of the pressure system used in the press of FIG. 1.
Figure 3:
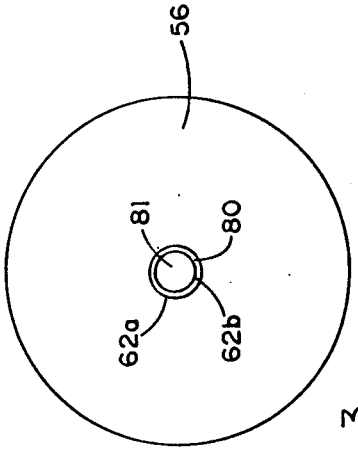
FIG. 3 is a diagrammatic side view of the ram used in the pressure system of FIG. 2.

Referring now to FIGS. 2 and 3, the pressure source 50 is depicted diagrammatically, and includes a housing, generally designated 52, having first, second and third chambers 53–55. Each of the chambers 53–55 is preferably cylindrically configured, with chamber 53 having slidably mounted therein a large-diameter piston 56 having a peripheral groove 57 thereabout for receiving therein suitable sealing means such as an annular seal 58. The piston 56 is axially movable within the chamber 53 by the use of air pressure or oil pressure. For this purpose, the housing portion **52*a* is provided with first and second fluid flow paths 59 and 60, each path being of the form of appropriately-drilled openings in opposite edges of the housing portion 52*a* for fluid communication between the interior of chamber 53 and the exterior of housing portion 52*a* by connection to a suitable air or oil pressure source. The fluid flow path 59, as viewed in FIG. 2, allows for the entry of appropriate pressure fluid to the left side of piston 56 for urging the piston 56 to the right, as viewed in FIG. 2. Correspondingly, the flow path 60 allows for introduction of fluid, be it air or oil, into the chamber 53 on the right side of piston 56, for the purpose of urging piston 56 to the left, as viewed in FIG. 2**.

Suitably secured to, or integrally formed with, the piston 56 is an axially-extending ram member 62. The ram 62 includes two axially-aligned sections **62*a* and 62*b*, with the diameter of section 62a being larger than the diameter of section 62*b*. As will be discussed. each ram section 62*a* and 62*b* is configured and adapted for operation within chambers 54 and 55, respectively, with each chamber 53–55 being of a different dimension. Each chamber 53–55 is physically separate, this separation being effected by means of construction of the housing 52. A wall 64 separates chambers 53 and 54, the wall 64 having an opening 65 on the longitudinal centerline of ram 62. The opening 65 is provided with a circumferential groove thereabout, for receiving therein an appropriate seal 66 in abutting relation with the periphery of ram section 62*a*. Similarly, a wall 68 exists between chambers 54 and 55 with an opening 69 therein, the opening 69 having a peripheral groove for receiving therein a suitable seal 70 which is in sealing relation with ram section 62*b*. Chamber 55 is provided with a closed end 71**.

The axial length of ram section **62*a* is generally equal to the length of chamber 54 plus the thickness of wall 64 of housing 52, this distance corresponding to the piston 56 being in the extreme right position shown in dotted lines and depicted 56'. In this position, the shoulder formed at the juncture of ram sections 62*a* and 62*b* is at the extreme right to the dotted line position 62*a*' within chamber 54, and ram section 62b abutting against, or in proximate relation to, the interior of end wall 71 within chamber 55, this position being depicted by dotted lines designated 62*b*'**.

Each of the chambers 54 and 55 is suitably filled with a noncompressable fluid such as hydraulic oil, with the piston 56 in its extreme left solid line position shown in FIG. 2. At the right end of chambers 54 and 55, fluid flow communication is provided by means of radially-extending openings 74 and 75, respectively. Each opening 74, 75 is suitably threaded for receiving therein an hydraulic fitting 76, 77, respectively. The fittings 76, 77 are coupled to appropriate hydraulic hoses to provide the fluid flow communication paths 44 and 44', respectively, to cylinders 42 and 42', respectively.

Referring now also to FIG. 3, the relative dimensions of the parts will now be described, Briefly, the ratios of the effective ram surface to volume within each of the chambers 54 and 55 is the same, the effective ram surface being the surface of the ram section as viewed from the end as shown in FIG. 3. The effective ram surface of ram section 62*a* is designated by the reference numeral 80, and correspondingly the effective ram surface of ram section 62*b* is designated by the reference numeral 81, each of the surfaces 80 and 80 being a ram head. The effective piston surface of piston 56 is shown in the outermost circle designated 56. Mathematically, the effective ram surface of ram head 80 is the cross-sectional area of a circle having a diameter equal to the circle surrounding the surface of ram head 80 which is the diameter of ram section 62*a* minus the surface area defined by the innermost circle of the surface of ram head 81 (which is the diameter of ram section 62*b*). That is, the ram head 80 is the shoulder at the junction of sections 62*a* and 62*b*, and it is this surface in the axial direction of movement of ram 62 that exerts force on the fluid.

The surface 81 is the end of ram section 62b, and by way of example, has a diameter sufficient to provide an area of one-half square inch. The diameter of ram section 62*a* is greater than the diameter of ram section 62*b*, with this diameter being of a magnitude sufficient to provide a total cross-sectional area of ram section 62*a* of one square inch. Thus, the surface of the annular shoulder surface of ram head 80 is equal to one-half square inch, the same surface area as the surface of ram head 81.

Again, by way of example, the diameter of piston 56 is selected to provide a 50:1 operating advantage, this equating to an effective surface area of piston 56 equal to fifty square inches. The operating advantage of the piston 56 is determine by the ratio of the effective surface area of piston 56 to the crosssectional area of the ram portion 62*a* within chamber 53. The cross-sectional area of ram portion 62*a* is one square inch. A piston 56 surface fifty times greater provides 50:1 power multiplication factor.

Dimensionally, each chamber 54, 55 is generally the same axial length, with the diameters thereof selected to provide equal, or substantially identical, volumes of hydraulic fluid therein with the ram sections 62*a* and 62*b* operative therein, as illustrated in FIG. 2. Thus, as ram 62 is axially displaced to the right, equal volumes of fluid are forced from chambers 54 and 55 simultaneously to the flow communication paths 44 and 44', respectively. Similarly, as the piston 56 moves axially to the left, equal volumes of fluid are drawn into chambers 54 and 55.

With the dimensions previously given, by way of example, if 100 psi of air or oil pressure is introduced into chamber 53 by means of opening 59, the pressure exerted on piston 56 is 5000 psi, which is transmitted, by means of ram 62, to each of the chambers 54 and 55 to thus provide 5000 psi through paths 44 and 44' to cylinders 42 and 42'. Assuming a surface area of two square inches on the pistons 40 and 40' of cylinders 42 and 42', this would equate to a force of 10,000 pounds operating on each of the pull rods 30.

With the common ram arrangement of the piston invention, in the event of unequal loading whereby a greater counterforce is exerted on one of the cylinders 42, 42', this counterforce will impact upon the effective ram surface in the chamber 54, 55 adversely affected. This adverse counterforce will then cause slowing or cessation of movement of the ram section thus affected. Since the ram sections 62*a* and 62*b* are effectively formed as a unit, any counterforce in either chamber 54 or 55 will automatically operate in both chambers 54 and 55.

In contrast, in the prior art, attempts were made to coordinate multiple pressure sources by linkages, cables, pulleys or the like. In such prior art devices, in the event of a counterforce operating on one pressure source, due to inherent stretch characteristics in cables, chains and pulleys, the flow of fluid to or from such multiple pressure sources was not equalized. Furthermore, with mechanical linkages such as arms or the like, the tolerances employed in connecting such linkages, and bending or stresses created within the linkage during such unbalanced conditions, again, did not truly equalize the effects of the unbalanced loading.

In accordance with the present invention, any unbalance due to uneven loading will instantly and simultaneously affect fluid flow to or from each of the chambers 54 and 55 in the same proportion at all times. In accordance with the present invention, while two operating chambers 54 and 55 have been illustrated utilizing a common ram 62 with proportionally-configured chamber dimensions and ram sections 62*a* and 62*b*, the invention is equally applicable to a press utilizing three, four or more cylinders similar to cylinders 42 in conjunction with a common ram having three, four or more proportionally-configured ram sections and three, four or more proportionally-configured separate chambers. In such an arrangement, all of the ram heads but one would be shoulders, such as ram head 80, and, of course, the ram would be driven by suitable means such as the piston 56 in an aligned chamber 53.

While there has been shown and described a preferred embodiment, it is to be understood that various other adaptations and modifications may be made within the spirit and scope of the invention.

We claim:

1. In a hydraulic press, the combination comprising:

bed means;

platen means;

means for coupling said bed means and said platen means for enabling relative movement therebetween, said coupling means including at least first and second hydraulic cylinder means;

housing means;

pressure actuating means including at least two axially aligned separate chambers in said housing means, and a ram member having at least first and second sections with first and second heads axially operable within said first and second chambers, respectively, the dimensions of said first and second chambers and said first and second sections being predetermined for providing substantially identical fluid displacement in each said chamber upon axial movement of said ram member between said first and second positions;

a first fluid flow path interconnecting said first chamber to said first cylinder;

a second fluid flow path interconnecting said second chamber to said second cylinder; and means for axially displacing said ram member for actuating said first and second cylinders simultaneously for providing relative displacement between said bed means and said platen means.

2. The combination according to claim 1 wherein said first ram section has a larger cross-sectional area than said second ram section, and the cross-sectional area of said first and second ram heads are equal.

3. The combination according to claim 2 wherein each of said chambers is generally circular in cross-section.

4. The combination according to claim 1 wherein said means for axially displacing said ram member includes piston means coupled thereto.

5. The combination according to claim 4 wherein said piston means includes a piston within a third chamber, said piston having a cross-sectional area substantially greater than the surface area of said ram head for providing pressure multiplication between the pressure applied to said piston and the pressure within said first and second chambers.

6. The combination according to claim 5 wherein said ram member is secured axially to the center of said piston.

7. The combination according to claim 6 wherein said third chamber is formed within said common housing.

8. The combination according to claim 7 wherein each of said sections and said piston is circular in cross-section.

9. The combination according to claim 8 wherein said first ram section has a larger cross-sectional area than said second ram section, and the cross-sectional areas of said first and second ram heads are equal.

10. The combination according to claim 9 wherein said housing means includes wall means between adjacent chambers and some of said wall means include aligned openings therein for passage therethrough of portions of said ram member.

11. The combination according to claim 1 wherein said first and second ram sections have different cross-sectional areas, and said first ram head is a shoulder at the junction of said first and second ram sections.

12. The combination according to claim 11 wherein said means for axially displacing said ram member includes a piston coupled thereto, said piston being within a third chamber and having a cross-sectional area substantially greater than the surface area of said ram head for providing pressure multiplication between the pressure applied to said piston and the pressure within said first and second chambers.

13. In a hydraulic press having a bed means and a platen means moveable in generally parallel relation to one another by means of at least first and second generally identical hydraulic cylinders, the improvement of pressure actuating means comprising:

a ram member having a first section having a predetermined cross-sectional area and a second axially aligned section having a pre-determined smaller cross-sectional area, each of said first and second section having a substantially identical effective cross-sectional surface area in the direction of axial movement of said ram member;

a first fluid-filled chamber having a peripheral wall portion and first and second end wall means;

a second fluid-filled chamber sharing said second end wall means adjacent to and axially aligned with said first chamber, said second chamber having a length generally equal to that of said first chamber and a third end wall means opposite said second end wall means;

a first centrally positioned axially extending opening in said first end wall means, said first opening being configured for matingly slidably receiving said first ram section therethrough;

a second centrally positioned axially extending opening in said second end wall means, said second opening being configured for matingly slidably receiving said second ram section therethrough, each of said sections having a length sufficient for axial operation within its respective chamber between first and second positions, the dimensions of said first and second chambers being predetermined relative to said effective surface area for providing substantially identical fluid displacement in each said chamber upon axial movement of said ram member between said first and second positions;

a first fluid flow path interconnecting said first chamber to said first cylinder;

a second fluid flow path interconnecting said second chamber to said second cylinder; and means for axially displacing said ram member for actuating said first and second cylinders simultaneously for providing relative displacement between said bed means and said platen means.

14. The combination according to claim 13 wherein said means for axially displacing said ram member includes piston means coupled thereto.

15. The combination according to claim 14 wherein said piston means includes a piston within a third chamber, said piston having a cross-sectional area substantially greater than said effective surface area for providing pressure multiplication between the pressure applied to said piston and the pressure within said first and second chambers.

16. The combination according to claim 15 wherein said ram member is secured axially to the center of said piston.

17. In a hydraulic press having a bed means and a platen means moveable in generally parallel relation to one another by means of at least first and second generally identical hydraulic cylinders, the improvement of pressure actuating means comprising:

a ram member having at least first and second axially aligned sections with first and second ram heads;

a first fluid-filled chamber means;

a second fluid-filled chamber means in abutting relation with said first chamber means and having a length generally equal thereto;

means in said first and second chambers for enabling the axial movement of said ram member therethrough with said first ram head in said first chamber and said second ram head within said second chamber, said ram being operable between first and second positions, the dimensions of said first and second chambers being predetermined relative to the surface area of said first and second ram heads for providing substantially identical fluid displacement in each said chamber upon axial movement of said ram member between said first and second positions;

a first fluid flow path interconnecting said first chamber to said first cylinder;

a second fluid flow path interconnecting said second chamber to said second cylinder; and means for axially displacing said ram member for actuating said first and second cylinders simultaneously for providing relative displacement between said bed means and said platen means.

18. The combination according to claim 17 wherein said means for axially displacing said ram member includes a piston coupled thereto, said piston being within a third chamber and having a cross-sectional area substantially greater than the surface area of said ram head for providing pressure multiplication between the pressure applied to said piston and the pressure within said first and second chambers.

19. The combination according to claim 18 wherein said third chamber is in abutting relation with one of said first and second chambers, and all of said chambers are formed in a common housing.

* * * * *